US005632181A

United States Patent [19]

Vanderzee et al.

[11] Patent Number: 5,632,181

[45] Date of Patent: May 27, 1997

[54] SYSTEM AND METHOD FOR TRANSFERRING A WORK PIECE IN A MULTI-STATION PRESS

[75] Inventors: Allen J. Vanderzee, St. John, Ind.; Edward J. Brzezniak; Adam Schwarz, both of Orland Park, Ill.

[73] Assignee: Verson, A Division of Allied Products Corporation, Chicago, Ill.

[21] Appl. No.: 393,554

[22] Filed: Feb. 23, 1995

[51] Int. Cl.[6] ..... B21D 43/05

[52] U.S. Cl. ..... 72/405.1; 72/405.11

[58] Field of Search ..... 72/405.16, 405.15, 72/405.13, 405.11, 405.1, 405.01, 421

[56] References Cited

U.S. PATENT DOCUMENTS

| | | | |
|---|---|---|---|
| 2,763,229 | 9/1956 | Sahlin | 113/50 |
| 2,867,185 | 1/1959 | Hayward | 113/50 |
| 2,941,799 | 6/1960 | Reincke | 271/27 |
| 3,101,941 | 8/1963 | Reincke | 271/27 |
| 3,178,040 | 4/1965 | Nelson | 214/1 |
| 3,179,262 | 4/1965 | Carlson et al. | 214/1 |
| 3,269,723 | 8/1966 | Staines | 271/27 |
| 3,855,840 | 12/1974 | Kawano | 72/418 |
| 3,875,808 | 4/1975 | Okamoto et al. | 74/29 |
| 3,937,056 | 2/1976 | Henzler | 72/405.11 |
| 3,937,457 | 2/1976 | Schwebel | 271/92 |
| 4,189,136 | 2/1980 | Robinette | 271/12 |
| 4,279,561 | 7/1981 | Schneider | 72/405.01 |
| 4,428,221 | 1/1984 | Owens | 72/405 |
| 4,509,356 | 4/1985 | Budrean et al. | 72/349 |
| 4,559,802 | 12/1985 | Budrean et al. | 72/349 |
| 4,562,719 | 1/1986 | Budrean et al. | 72/349 |
| 4,566,306 | 1/1986 | Orii | 72/346 |
| 4,625,540 | 12/1986 | Yamada et al. | 72/405 |
| 4,625,850 | 12/1986 | Marsh | 192/143 |
| 4,641,515 | 2/1987 | Braun et al. | 72/405 |
| 4,658,626 | 4/1987 | Yamada et al. | 72/405 |
| 4,682,685 | 7/1987 | Yamada et al. | 198/621 |
| 4,697,448 | 10/1987 | Stevens | 72/405.11 |
| 4,713,961 | 12/1987 | Hoehn et al. | 72/419 |
| 4,730,825 | 3/1988 | Mikusch et al. | 271/268 |

(List continued on next page.)

FOREIGN PATENT DOCUMENTS

| | | |
|---|---|---|
| 325841 | 2/1989 | European Pat. Off. . |
| 4001591 | 8/1990 | Germany . |
| 198164 | 6/1983 | Japan . |
| 95355 | 11/1985 | Japan . |
| 161825 | 2/1987 | Japan . |
| 238032 | 10/1987 | Japan . |
| 273530 | 11/1988 | Japan . |
| 2299729 | 12/1990 | Japan . |
| 38526 | 1/1991 | Japan . |
| 4300036 | 10/1992 | Japan . |
| 2244227 | 11/1991 | United Kingdom . |
| 2264254 | 8/1993 | United Kingdom . |

OTHER PUBLICATIONS

Stegman, *Motion Control Technology AG 626 Configurable Multi–Turn Absolute Angle Encoder,* 1994. (4 pgs.).

Brochure, Custom Servo Motor, Inc., *MaxPlus Motors and Equipment,* no date. (2 pgs.).

William G. Anderson, *NdFeB Magnet Material in High Performance Brushless Servo Motors,* 1992. (5pgs.).

Brochure, Custom Servo Motors Inc., *Introducing the Max-Plus Series,* no date. (2 pgs.).

*Primary Examiner*—Daniel C. Crane

*Attorney, Agent, or Firm*—Baker & Botts, L.L.P.

[57] ABSTRACT

A multistation transfer press (10) is provided. Cross bar assemblies (28) transfer work pieces (12) between adjacent press stations (14) in transfer press ten (10). Each cross bar assembly (28) moves work pieces (12) between adjacent press stations (14). Motions of cross bar assemblies (28) is provided by raising and lowering transfer rails (22) and (24) along with reciprocating cross bar assemblies (28) along transfer rails (22) and (24). Cross bar assemblies (28) are operable to dynamically orient work pieces (12) during transfer between adjacent press stations (14). Additionally, a portion of the motion of cross bar assemblies (28) occurs while upper dies (20) and lower dies (18) are separated by less than a maximum distance.

26 Claims, 12 Drawing Sheets

U.S. PATENT DOCUMENTS

| | | | |
|---|---|---|---|
| 4,754,955 | 7/1988 | Otsuka et al. | 267/119 |
| 4,807,456 | 2/1989 | Shiraishi et al. | 72/405 |
| 4,848,764 | 7/1989 | Tajima et al. | 271/90 |
| 4,866,974 | 9/1989 | Shiraishi et al. | 72/405 |
| 4,929,164 | 5/1990 | Duina | 425/145 |
| 4,941,793 | 7/1990 | Shiraishi et al. | 414/225 |
| 4,958,824 | 9/1990 | Willits et al. | 271/11 |
| 4,981,031 | 1/1991 | Schneider et al. | 72/405 |
| 5,001,921 | 3/1991 | Schneider et al. | 72/405 |
| 5,029,836 | 7/1991 | Swaneck | 271/107 |
| 5,031,441 | 7/1991 | Jones | 72/420 |
| 5,048,318 | 9/1991 | Thudium et al. | 72/405 |
| 5,054,306 | 10/1991 | Brzezniak | 72/405 |
| 5,064,183 | 11/1991 | Nishigaki et al. | 271/10 |
| 5,072,823 | 12/1991 | Takahashi et al. | 198/468.4 |
| 5,097,695 | 3/1992 | Brzezniak | 72/405 |
| 5,103,965 | 4/1992 | Takahashi et al. | 198/468.4 |
| 5,121,623 | 6/1992 | Brzezniak | 72/405 |
| 5,140,839 | 8/1992 | Bruns | 72/405 |
| 5,148,697 | 9/1992 | Shiraishi et al. | 72/405 |
| 5,159,827 | 11/1992 | Shiraishi et al. | 72/405 |
| 5,248,288 | 9/1993 | Kamiya et al. | 483/28 |
| 5,257,899 | 11/1993 | Asakura et al. | 414/752 |
| 5,269,168 | 12/1993 | Ogawa | 72/405 |
| 5,350,166 | 9/1994 | Shimizu et al. | 271/14 |
| 5,352,086 | 10/1994 | Mank | 414/797 |
| 5,359,875 | 11/1994 | Sova | 72/336 |
| 5,363,683 | 11/1994 | Thudium et al. | 72/405 |
| 5,363,684 | 11/1994 | Thudium et al. | 72/405 |
| 5,363,685 | 11/1994 | Luthi et al. | 72/405 |
| 5,368,286 | 11/1994 | Horsman et al. | 271/11 |
| 5,372,066 | 12/1994 | Proctor | 101/118 |
| 5,383,348 | 1/1995 | Michael et al. | 72/405 |
| 5,385,040 | 1/1995 | Michael et al. | 72/405 |
| 5,388,952 | 2/1995 | Hofele et al. | 414/752 |
| 5,445,370 | 8/1995 | Soga | 271/12 |

SYSTEM AND METHOD FOR TRANSFERRING A WORK PIECE IN A MULTI-STATION PRESS

TECHNICAL FIELD OF THE INVENTION

This invention relates in general to the field of multi-station presses. More particularly, the present invention relates to a system and method for transferring a work piece in a multi-station press.

BACKGROUND OF THE INVENTION

Sheet metal is used to form the basic components of many commercial products. For example, sheet metal is used to form parts for automobiles, appliances, airplanes and other mass produced items. To transform the sheet metal into an appropriately sized and shaped part, the sheet metal is pressed, bent, cut, pierced, trimmed, etc.

A transfer press is typically used to expedite the process of forming parts from sheet metal. Transfer presses typically include several upper and lower die combinations referred to as press stations that are arranged in a line within the transfer press. The dies for each press station are chosen to perform specified functions to create the desired part. Additionally, the transfer press includes an automated system that transfers the parts from one station to the next to increase the rate of output by the transfer press.

Over the years, the size of parts formed from sheet metal have increased significantly. For example, individual parts for automobiles such as doors and body panels have increased in size. The larger parts slow down the transfer press thus decreasing its throughput capability. It simply takes longer to move a large part between the press stations. Additionally, the larger parts make it more difficult to reorient the part between dies because the larger parts are more difficult to handle.

Prior systems and methods for transferring a work piece in a multi-station press have used independent vertical and horizontal movement of a cross bar assembly. This independent vertical and horizontal movement limited the rate at which large work pieces could be processed. Other prior systems used simultaneous vertical and horizontal movement of the cross bar assembly to increase the output rate of the transfer press. This type of movement is shown by way of example in U.S. Pat. No. 5,148,697 issued to Shiraishi, et al. entitled METHOD FOR WITHDRAWING WORK PIECE FROM DRAWING MOLD and U.S. Pat. No. 4,981,031 issued to Schneider, et al. entitled TRANSFER DEVICE IN A TRANSFER PRESS OR SIMILAR METAL-FORMING MACHINE. Shiraishi and Schneider both disclose movement of a cross bar along a curved path from a rest position between stations to a first press station. The part is transplanted from the first press station to a second press station over a curved path and the cross bar returns to the rest position between press stations. The cross bar stays in the rest position during a press operation.

The Schneider patent also shows cross bar assemblies with carriages formed in a low-mass construction. This low-mass construction allows increased acceleration and thus the press may operate at a higher speed. Schneider also discloses idle stations disposed between each of the press stations to help in reorienting the part for subsequent processing. Although the idle stations may allow for shortening the transfer movements of the press, they also introduce a delay by adding extra stations. Additionally, the idle stations also require additional tooling. The idle stations add to the possibility of damaging the work piece by doubling the number of times the work piece is handled.

Therefore, a need has arisen for a system and method for transferring a work piece in a multi-station press that increases the speed at which large parts may be produced by the press, reduces the potential for damaged parts and allows for reorientation of a part between presses without significantly decreasing the speed of the press.

SUMMARY OF THE INVENTION

In accordance with the present invention, a system and method for transferring a work piece in a multistation press is provided that substantially eliminates or reduces disadvantages and problems associated with the previously developed systems and methods. More specifically, the present invention includes in one embodiment a system for transferring a work piece in a multi-station press having a plurality of associated upper and lower dies. The system includes at least one cross bar assembly that extends above the press stations perpendicular to the transfer direction of the press. A plurality of holding devices are coupled to the cross bar assembly for removably engaging a work piece to be moved between the press stations. Additionally, the cross bar assembly moves in a cyclical manner between the press stations to move the work piece between adjacent first and second press stations. The cross bar assembly begins in a first rest position adjacent to the second press station. The cross bar assembly first moves into the first press station wherein the holding devices engage a work piece and move the work piece to the second press station. The cross bar assembly next moves from the second press station to a second rest position. The second rest position is located adjacent to the first press station. Finally, the cross bar assembly returns to the first rest position. A predetermined portion of the movement from and to the rest positions may occur while the upper die is separated from the lower die by less than a maximum separation.

A technical advantage of the present invention includes in one embodiment that the cross bar assembly moves toward a first press station before the upper and lower dies are completely separated and moves away from a second press station while the upper die begins to move toward the lower die, thus increasing the speed and efficiency with which the press is able to transfer large work pieces.

According to another aspect of the present invention, the cross bar assemblies may be programmed to provide dynamic orientation of the work piece during transfer between press stations. In one embodiment, each cross bar assembly includes a pair of opposite carriages. Two cross bars extend between each pair of carriages. The carriages are mounted on a pair of transfer rails that extend along the length of the transfer press. Each carriage further includes a vertical member, a horizontal member and a rotational member. The vertical, horizontal and rotational members are coupled to the carriages such that the cross bars may be independently rotated translated vertically, and translated horizontally with programmability. Finally, sets of vacuum cups are slidably attached to the cross bars. Each set of vacuum cups may move along the cross bar independently with programmability.

Another technical advantage of the present invention includes in one embodiment that it may be used to orient a work piece in a transfer press while moving the work piece from one station to the next thus eliminating the need for idle stations and increasing the rate of output of the transfer press. The cross bar assembly can be programmed to tilt the work piece in the direction of flow or in a direction perpendicular to the direction of flow. Additionally, the cross bar assembly itself can be programmed to raise and lower the work piece with respect to the transfer rails.

Another technical advantage of the present invention includes that the cross bars may be stored close together in the rest position and may separate from each other when moving into a press station to engage and lift a work piece. This increases the speed and efficiency of the press by decreasing the space requirements for the rest positions and thus decreasing the overall distance travelled by the work piece in the transfer press.

Another technical advantage of the present invention is that cross bars may move in tandem so as to increase or decrease the effective distance that a work piece travels between press stations. This allows the press stations to be spaced at varying intervals along the transfer press while the cross bar assemblies are spaced at a fixed distance apart.

Another technical advantage of the present invention is that a single cross bar assembly may transfer multiple parts simultaneously through the transfer press. A cross bar assembly can be programmed to separate parts in the direction of flow. Additionally, the cross bar assembly can be programmed to separate parts perpendicular to the direction of flow. In fact, each set of vacuum cups could be used to transfer a separate work piece.

Another technical advantage of the present invention is that the transfer mechanism is not designed to be dedicated to a specific work piece. The same cross bars and vacuum cup sets can be used to transfer a wide variety of work pieces without changing out the cross bars.

Another technical advantage of the present invention is that the transfer rails do not extend beyond the confines of the transfer press during operation. Rather, the carriages move back-and-forth on the rails the reducing the chance of inadvertent injury from horizontal movement of the transfer rails.

Another technical advantage of the present invention is that it includes an overload device which releases the cross bar if it hits an interference. This feature minimizes the damage to the cross bar.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
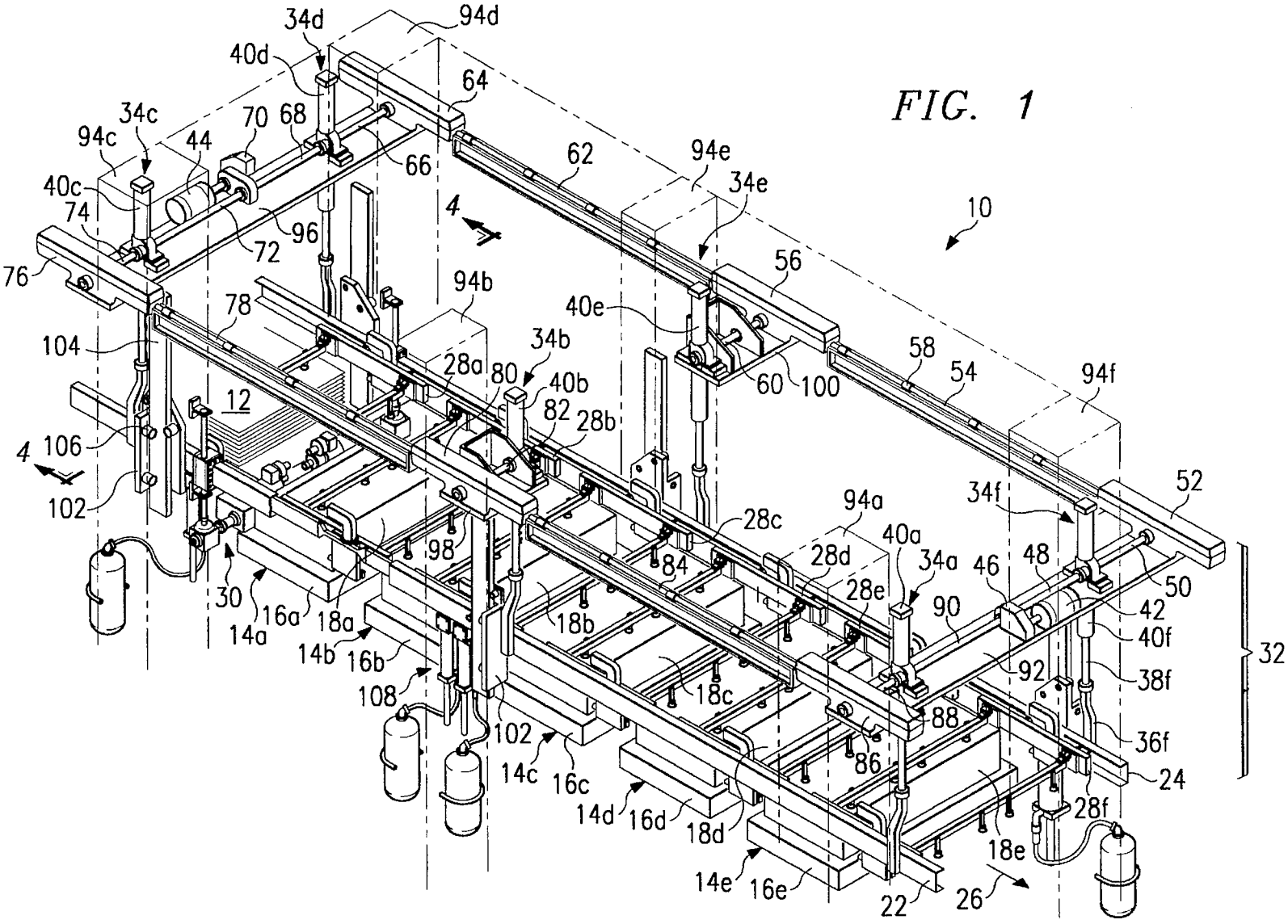
FIG. 1 is a perspective view with portions broken away of one embodiment of a multi-station press and a system for transferring a work piece within the press constructed according to the teachings of the present invention.

FIG. 1 illustrates a multi-station, or transfer press, indicated generally at 10 and constructed according to the teachings of the present invention. Transfer press 10 moves work pieces 12 through a plurality of press stations 14*a* through 14*e* to create a desired output. Each press station 14*a* through 14*e* comprises an associated bolster 16*a* through 16*e*, lower die 18*a* through 18*e*, and a cooperating upper die 20*a* through 20*e* (shown in FIGS. 6*a* through 6*f*), respectively. Transfer press 10 further includes a conventional slide (not shown) for raising and lowering upper dies 20*a* through 20*e* such as described and shown in U.S. Pat. No. 5,097,695.

Transfer press 10 includes a system for transferring work pieces between press stations 14*a* through 14*e*. The transferring system includes a pair of transfer rails 22 and 24 mounted on opposite sides of press stations 14*a* through 14*e* and extending in a transfer direction of press 10 as indicated by arrow 26. It is noted that transfer rail 22 and 24 do not extend beyond the confines of transfer press 10 during operation. Thus the risk of inadvertent injury is reduced.

The transfer system simultaneously provides vertical and horizontal movement to transfer work pieces 12 between adjacent press stations 14 along a non-linear path shown and described with respect to FIGS. 6*a* through 6*g* below. The horizontal component of the movement of work pieces 12 is provided by a plurality of cross bar assemblies 28*a* through 28*f* and a feed drive mechanism indicated generally at 30. This aspect of the transferring system is described in detail below with respect to FIGS. 3 through 5. The vertical component of the movement of work pieces 12 is provided by a lift mechanism indicated generally at 32.

Lift mechanism 32 of press 10 provides vertical movement to work pieces 12 by raising and lowering rails 22 and 24. Lift mechanism 32 includes a plurality of vertical lift assemblies indicated generally at 34*a* through 34*f* disposed along the length of rails 22 and 24. As shown, lift mechanism 32 comprises three vertical lift assemblies 34*a*, 34*b*, and 34*c* disposed along transfer rail 22 and three vertical lift assemblies 34*d*, 34*e* and 34*f* disposed along the length of transfer rail 24. It is understood that the number of vertical lift assemblies 34 may be varied in accordance with the teachings of the present invention as the number of press stations 14 or the size of transfer press 10 are varied. Each vertical lift assembly 34 comprises a support member 36 that is coupled to one of transfer rails 22 and 24. For example, support members 36*a* through 36*c* are coupled to transfer rail 22. Additionally, support members 36*d* through 36*f* are coupled to transfer rail 24. Lift rods 38*a* through 38*f* couple corresponding support members 36*a* through 36*f* to vertical rack and pinion assemblies 40*a* through 40*f*. Each vertical rack and pinion assembly 40*a* through 40*f* may comprise a part number ST 1400-VP-50 commercially available from Flo-Tork in Orrville, OH or any other appropriate part for translating rotational motion into linear motion.

Vertical lift assemblies 34*a* through 34*f* raise and lower transfer rails 22 and 24 through a drive mechanism including drive motors 42 and 44. Drive motor 42 is coupled to a right angle gear box 46. A torque tube 48 is coupled between right angle gear box 46 and the pinion of vertical rack and pinion assembly 40*f*. A torque tube 50 is also coupled between the pinion of vertical rack and pinion assembly 40*f* and a pinion of first horizontal rack and pinion assembly 52. A drive rod 54 is coupled between the rack of horizontal rack and pinion assembly 52 and a rack of a second horizontal rack and pinion assembly 56. Drive rod 54 is guided by ball bushings 58 spaced out along the length of drive rod 54. A torque tube 60 is coupled between the pinion of second horizontal rack and pinion assembly 56 and vertical rack and pinion assembly 40*e*. Additionally, a drive rod 62 is coupled between the rack of second horizontal rack and pinion assembly 56 and a third horizontal rack and pinion assembly 64. A torque tube 66 is coupled between the pinion of third horizontal rack and pinion assembly 64 and a pinion of vertical rack and pinion assembly 40*d*. A torque tube 68 is coupled between the pinion of vertical rack and pinion assembly 40*d* and a right angle gear box 70. Drive motor 44 is also coupled to right angle gear box 70. A torque tube 72 is coupled between right angle gear box 70 and a pinion of vertical rack and pinion assembly 40*c*. A torque tube 74 is coupled between the pinion of vertical rack and pinion assembly 40*c* and the pinion of fourth horizontal rack and pinion assembly 76. A drive rod 78 is coupled between the rack of fourth horizontal rack and pinion assembly 76 and the rack of fifth horizontal rack and pinion assembly 80. A torque tube 82 is coupled between the pinion of fifth horizontal rack and pinion assembly 80 and the pinion of vertical rack and pinion assembly 40*b*. A drive rod 84 is coupled between the rack of fifth horizontal rack and pinion assembly 80 and a sixth horizontal rack and pinion assembly 86. A torque tube 88 is coupled between the pinion of sixth horizontal rack and pinion assembly 86 and the pinion of vertical rack and pinion assembly 40*a*. Finally, a torque tube 90 is coupled between vertical rack and pinion assembly 40*a* and right angle gear box 46. Lift mechanism 32 operates by translating rotationally motion provided by drive motors 42 and 44 into linear motion of support members 36*a* through 36*f* to raise and lower transfer rails 22 and 24 as described below.

A portion of lift mechanism 32 of transfer press 10 is suspended above transfer rails 22 and 24. A support platform 92 is coupled between vertical columns 94*a* and 94*f*. Drive motor 42, vertical rack and pinion assemblies 40*a* and 40*f*, and first and sixth horizontal rack and pinion assemblies 52 and 86 are disposed on support platform 92. Similarly, drive motor 44, vertical rack and pinion assemblies 40*c* and 40*d*, and third and fourth horizontal rack and pinion assemblies 64 and 76 are disposed on a support platform 96 between vertical columns 94*c* and 94*d* of transfer press 10. A support platform 98 is coupled to vertical column 94*b* of transfer press 10 to support fifth horizontal rack and pinion assembly 80 and vertical rack and pinion assembly 40*b*. Finally, a support platform 100 is coupled to a vertical column 94*e* to support second horizontal rack and pinion assembly 56 and vertical rack and pinion assembly 40*e*. The vertical motion of transfer rails 22 and 24 is guided by guide members 102. Guide members 102 are slidably mounted on linear member 104 by a plurality of guide pins 106. As shown, guide members 102 each comprise a right angle body having guide pins 106 extending perpendicular to surfaces of guide member 102 so as to slidably engage linear member 104. Each linear member 104 is coupled to a vertical column 94 of transfer press 10. Only two linear members 104 are shown in FIG. 1. However, it is noted that at least one linear member 104 may be coupled to each vertical column 94 to maintain transfer rails 22 and 24 in a constant vertical plane as transfer rails 22 and 24 are raised and lowered.

In operation, vertical lift assemblies 34*a* through 34*f* raise and lower transfer rails 22 and 24. In raising transfer rails 22 and 24, lift drive motor 42 provides a first predetermined rotational motion to torque tube 48. Torque tube 48 turns the pinion of vertical rack and pinion assembly 40*f*. The pinion engages the rack in vertical rack and pinion assembly 40*f* and thus raises lift rod 38*f*, support member 36*f* and rail 24. Motor 42 also rotates torque tube 50. Torque tube 50 rotates the pinion of first horizontal rack and pinion assembly 52. The pinion engages the rack of first horizontal rack and pinion assembly 52. Drive rod 54 thus extends toward second horizontal rack and pinion assembly 56. Torque tube 60 rotates with the pinion of second horizontal rack and pinion assembly 56. Thus, vertical rack and pinion assembly 40*e* raises lift rod 38*e*, support member 36*e* and transfer rail 24. Motors 42 and 44 similarly control vertical lift assemblies 34*a* through 34*d*.

Figure 2A:
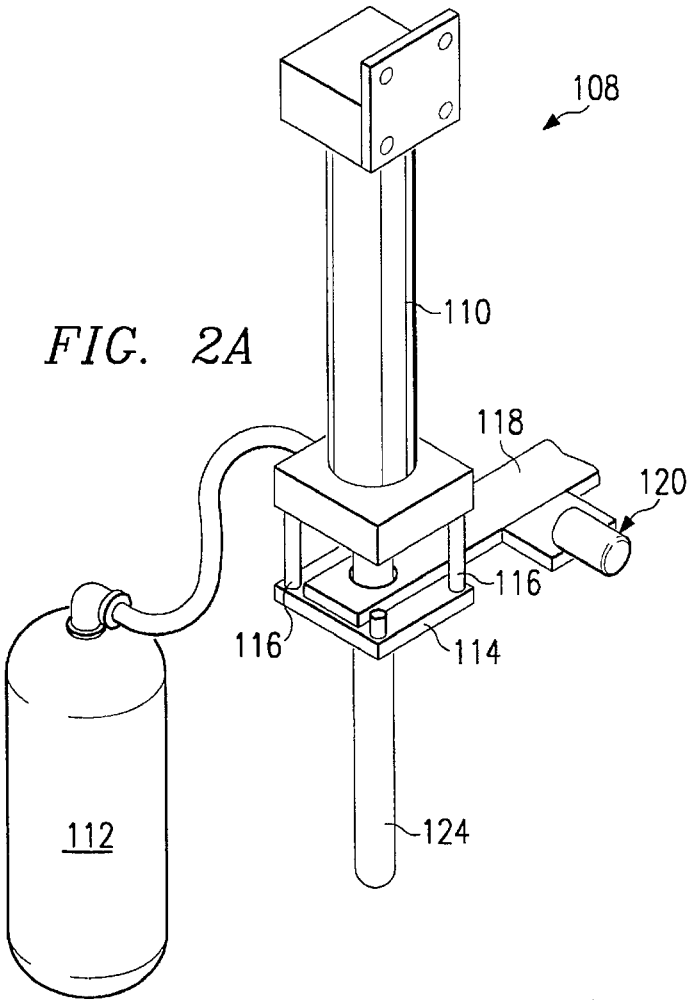
FIGS. 2*a* and 2*b* are perspective views of a safety mechanism constructed according to the teachings of the present invention for a counter balance system for the multi-station press of FIG. 1.
Figure 2B:
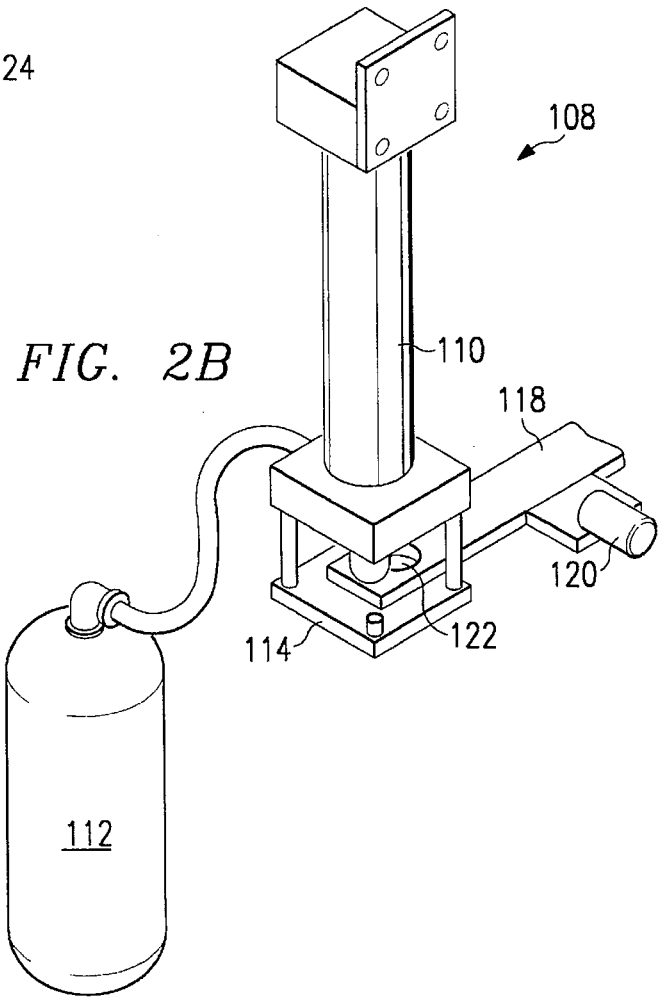

Transfer press 10 further includes a plurality of counterbalance assemblies 108 disposed along the length of transfer rails 22 and 24 to reduce the amount of force necessary to lift transfer rails 22 and 24. FIG. 2*a* and 2*b* illustrate one embodiment of a counterbalance assembly indicated generally at 108. Counterbalance assembly 108 comprises a counterbalance cylinder 110 and a reservoir 112 coupled to cylinder 110 so as to maintain the proper pressure within cylinder 110. In operation, the pressure in cylinder 110 causes an upward force to counterbalance the weight of an associated transfer rail 22 or 24.

Counterbalance assembly 108 further includes a support plate 114 separated from cylinder 112 by spacers 116. An anti-drift plate 118 is slidably disposed on support plate 114. Motion of anti-drift plate 118 is controlled by linear actuator motor 120. A cylindrical opening 122 is provided in anti-drift plate 118 to receive lift lock rod 124.

Figure 3:
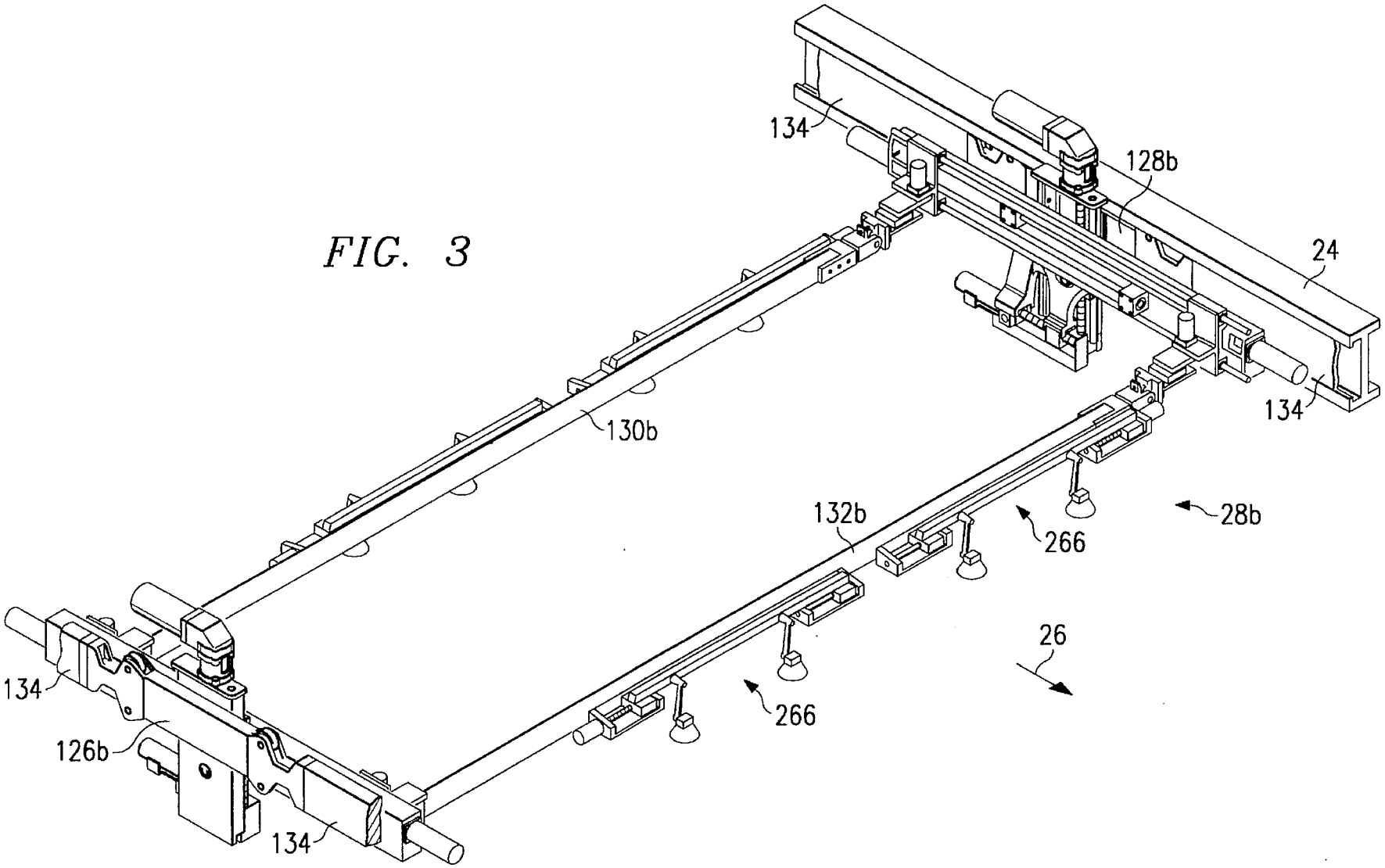
FIG. 3 is a perspective view of a cross bar assembly constructed according to the teachings of the present invention for use in the multi-station press of FIG. 1.

In operation, counterbalance assembly 108 prevents transfer rails 22 and 24 from inadvertently lowering when lower dies 18*a* through 18*e* are being changed. During normal operation, lift lock rod 124 extends through cylindrical opening 122 as shown in FIG. 2*a*. When a lower die 18 is changed, transfer rails 22 and 24 are raised as described above. Lift lock rod 124 moves up through cylindrical opening 122. Once lift lock rod 124 is clear of the top of anti-draft plate 118, linear actuator motor 120 moves anti-drift plate 118 to the position shown in FIG. 2*b* such that lift lock rod 124 does not line up with cylindrical opening 122. Thus, transfer rails 22 and 24 are located in a raised position while lower dies 18*a* through 18*e* are changed. The horizontal component of the movement of work pieces 12 is provided by cross bar assemblies 28*a* through 28*f* that reciprocate on transfer rails 22 and 24. FIG. 3 shows an embodiment of a cross bar assembly indicated generally at 28*b* with transfer rail 22 removed for clarity. Although only cross bar assembly 28*b* is shown, the description of FIG. 3 is applicable to each cross bar assembly 28*a* through 28*f*.

Cross bar assembly 28*b* extends between transfer rails 22 and 24 in a direction perpendicular to transfer direction 26.

Cross bar assembly 28b comprises a first carriage 126b slidably mounted on transfer rail 22 and an associated carriage 128b slidably mounted on rail 24. First and second cross bars 130b and 132b respectively, are coupled between carriages 126b and 128b. Carriage 126b is separated from next adjacent carriages by spacing members 134. Similarly, carriage 128b is also separated from next adjacent carriages by spacing members 134. Cross bar assembly 28b reciprocates back and forth along rails 22 and 24 so as to move a work piece 12 between press stations 14a and 14b.

Figure 4:
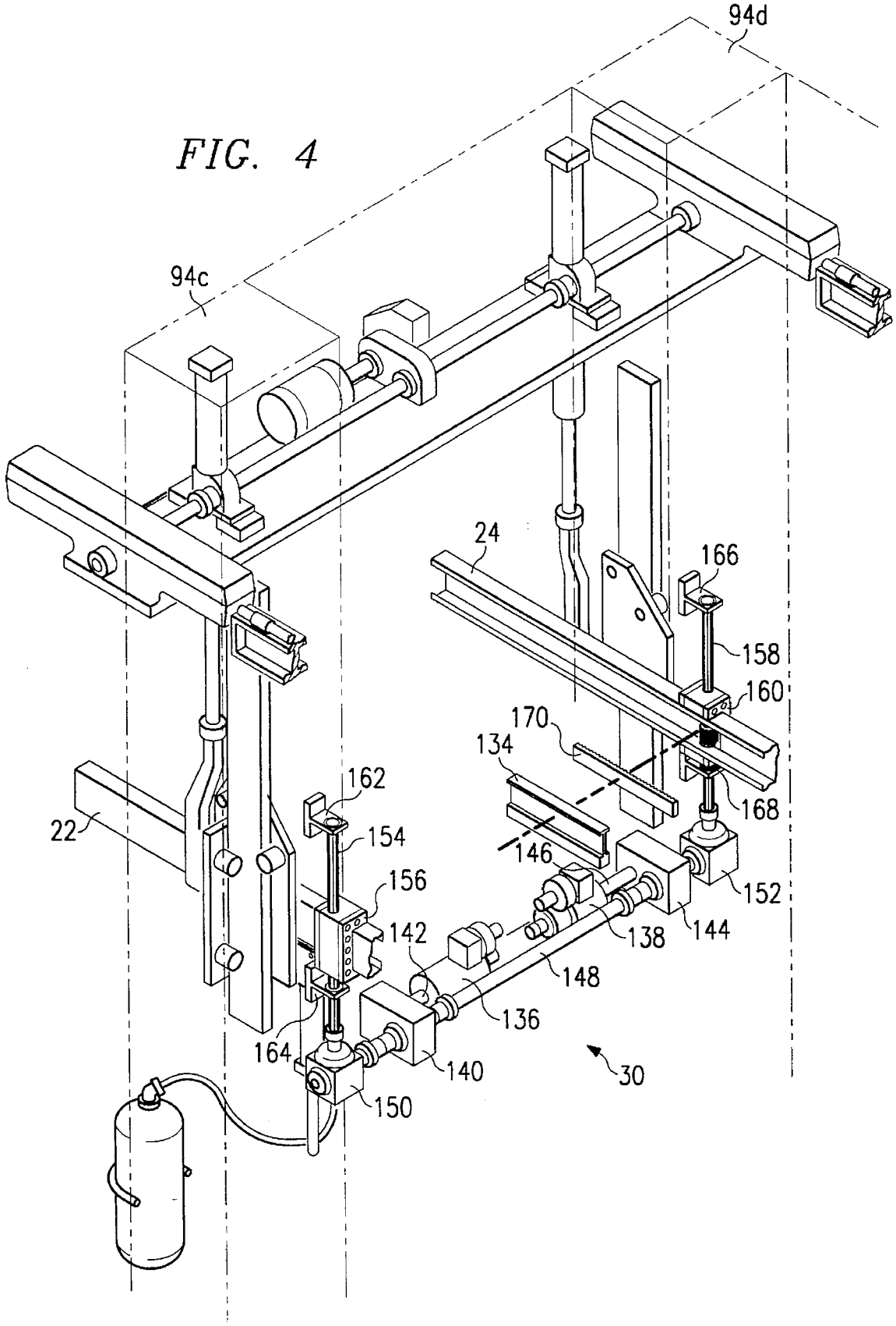
FIG. 4 is a perspective view taken along lines 4—4 of the multi-station press of FIG. 1 with portions broken away.

FIG. 4 is a perspective view taken along lines 4—4 of the transfer press 10 of FIG. 1 with portions broken away. Transfer press 10 includes a feed drive mechanism indicated generally at 30 for reciprocating cross bar assemblies 28a through 28f of FIG. 1 on transfer rails 22 and 24. Feed drive mechanism 30 creates rotational motion and translates the rotational motion to provide linear motion for driving cross bar assemblies 28a through 28f.

Feed drive mechanism 30 includes first and second feed drive motors 136 and 138, respectively for creating rotational motion. Feed drive motor 136 is coupled to a feed drive gear box 140 by a torque tube 142. Similarly, feed drive motor 138 is coupled to a feed drive gear box 144 through a torque 146. Feed drive gear boxes 140 and 144 are coupled together through coupling 148. Feed drive gear box 140 is coupled to an angle gear box 150 and feed drive gear box 144 is coupled to an angle gear box 152.

Angle gear box 150 is coupled to a spline shaft 154 for translating rotational motion of motors 136 and 138 to linear motion of carriages 126a through 126f. A pinion support housing 156 is coupled to transfer rail 22. Spline shaft 154 passes through pinion support housing 156. Similarly, a spline shaft 158 is coupled to angle gear box 152 for translating rotational motion provided by motors 136 and 138 to linear motion of carriages 128a through 128f as described below. A pinon support housing 160 is coupled to transfer rail 24. Spline shaft 158 passes through pinion support housing 160. Spline shaft 154 is held in place by support members 162 and 164 coupled to a vertical column 94c. Similarly, spline shaft 158 is held in place by support members 166 and 168. Support members 166 and 168 are coupled to vertical column 94d.

Figure 5:
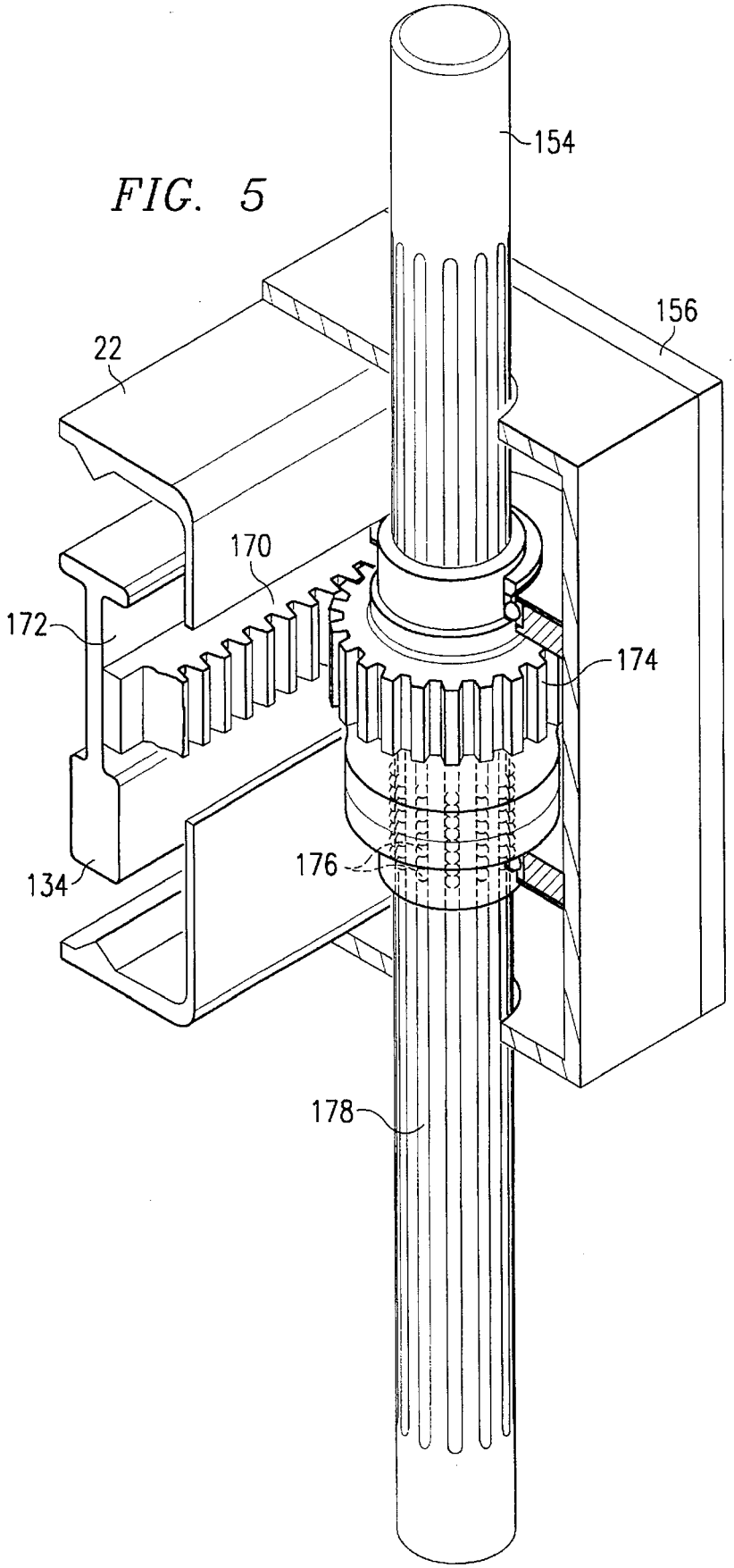
FIG. 5 is a perspective view in partial cross section of a portion of the transfer drive mechanism of the multi-station press of FIG. 1 constructed according to the teachings of the present invention.

FIG. 5 is an enlarged view of a portion of feed drive mechanism 30 at an interface with transfer rail 22 and spacing member 134. It is understood that feed drive mechanism 30 similarly interfaces with spacing member 134 and transfer rail 24. As shown, a rack 170 is provided along a backside 172 of spacing member 134. Rack 170 is engaged by a pinion 174 in pinion support housing 156. As transfer rail 22 is raised and lowered, pinion support housing 156 and pinion 174 raise and lower on spline shaft 154. This motion is allowed in part by a plurality of ball bearings 176 disposed in pinion support housing 156 along a length of shaft 154 in grooves 178. Additionally, pinion 174 is operable to rotate with spline shaft 154 to translate rotational motion of shaft 154 into linear motion of rack 170 and spacing member 134.

In operation, transfer rail 22 is raised and lowered by vertical lift assemblies 34a, 34b and 34c. Pinion support housing 156 is similarly raised and lowered on spline shaft 154 in conjunction with the motion of transfer rail 22. Feed drive mechanism 30 moves cross bar assemblies 28a through 28f along transfer rails 22 and 24 in a horizontal direction. Drive motors 136 and 138 create rotational motion which is transmitted to spline shafts 154 and 158 by gear boxes 140, 144, 150, and 152. Pinions 174 rotate within pinion housings 156 and 160. Pinions 174 engage racks 170 to translate rotational motion of spline shafts 154 and 158 into linear motion of cross bar assemblies 28a through 28f.

FIGS. 6a through 6g illustrate a method for transferring a work piece in transfer press 10 of FIG. 1. For purposes of clarity, the method of transferring a work piece 12 within transfer press 10 is only described with respect to the movement of cross bar assembly 28b between press stations 14a and 14b. It is understood that cross bar assemblies 28a and 28c through 28f operate in a similar manner between a loading station and a press station 14, between two press stations 14, or between a press station 14 and an unloading station. The method of FIGS. 6a through 6g is designed to increase production rates over conventional systems as described in detail below.

Figure 6A:
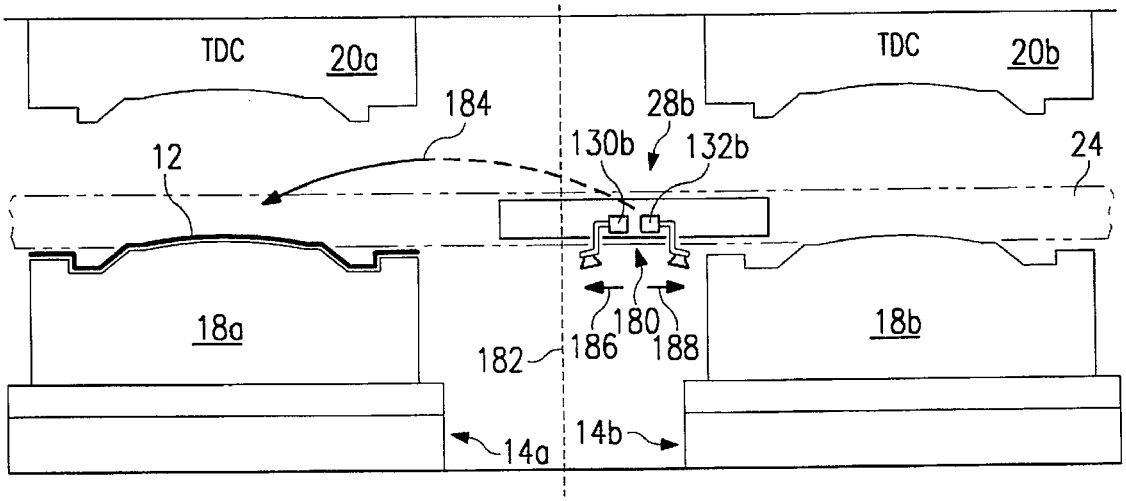
FIGS. 6*a* through 6*g* illustrate a method of transferring a work piece between adjacent stations in the multi-station press of FIG. 1 according to the teachings of the present invention.

As shown in FIG. 6a, cross bar assembly 28b begins with first and second cross bars 130b and 132b located in close proximity to one another. Cross bar assembly 28b is located at a first rest position 180 between adjacent press stations 14a and 14b. First rest position 180 is located adjacent to second press station 14b. This means that rest position 180 is located on the side of a midpoint 182 between press stations 14a and 14b that is closer to press station 14b.

When a press operation is completed, upper dies 20a and 20b begin to separate from lower dies 18a and 18b, respectively. Cross bar assembly 28b then follows a path approximated by arrow 184 to engage work piece 12 in press station 14a. The curved motion represented by arrow 184 is obtained by simultaneously raising and then lowering transfer rails 22 and 24 while moving cross bar assembly 28b along transfer rails 22 and 24 toward press station 14a.

The dashed portion of arrow 184 represents motion of cross bar 28b that occurs before upper die 20a reaches a top dead center position. Movement of cross bar assembly 28b prior to top die 20a reaching a top dead center position allows the method of the present invention to increase the throughput capability of transfer press 10. Cross bar assembly 28b reaches a maximum speed upon entering press station 14a. Then, cross bar assembly 28b decelerates as it lowers down to engage work piece 12. Additionally, cross bars 130b and 132b separate in directions indicated by arrows 186 and 188 as cross bar assembly 28b follows the path shown by arrow 184.

Figure 6B:
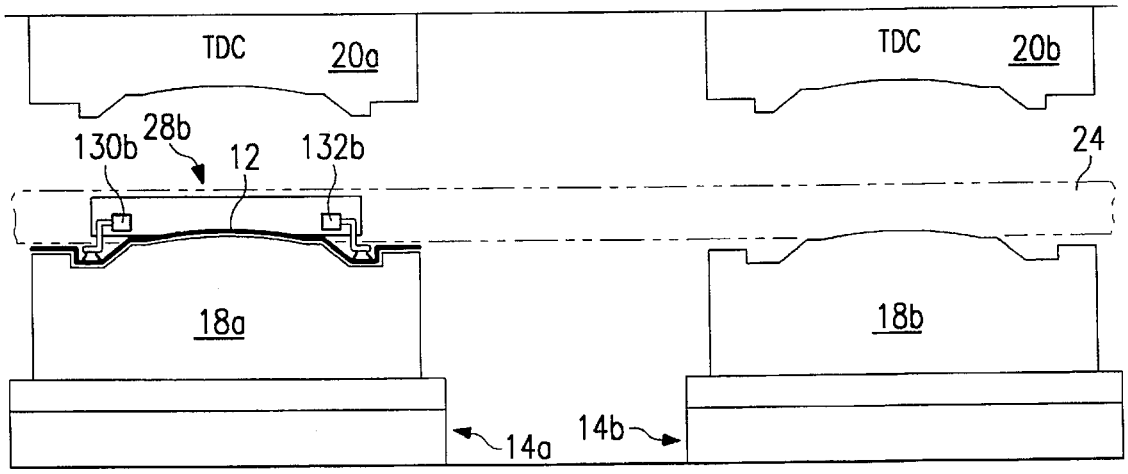
Figure 6C:
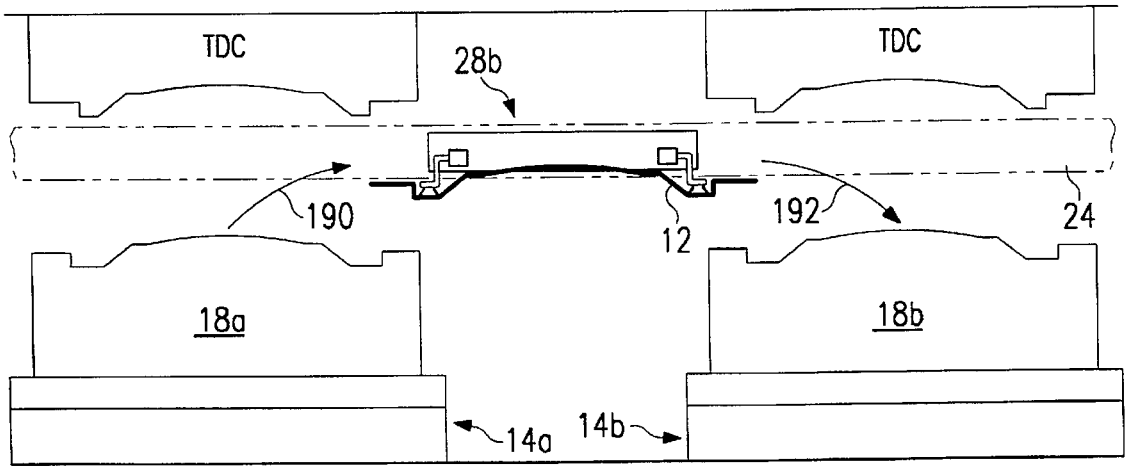

As shown in FIG. 6b, cross bars 130b and 132b engage work piece 12 on bottom die 18a at press station 14a. At this time, upper dies 20a and 20b are located in the top dead center position. As shown in FIG. 6c, work piece 12 is transported to press station 14b by cross bar assembly 28b over a curved path represented by arrows 190 and 192. Again, the curved motion of cross bar assembly 28b is caused by the simultaneous movement of transfer rails 22 and 24 and cross bar assembly 28b.

Figure 6D:
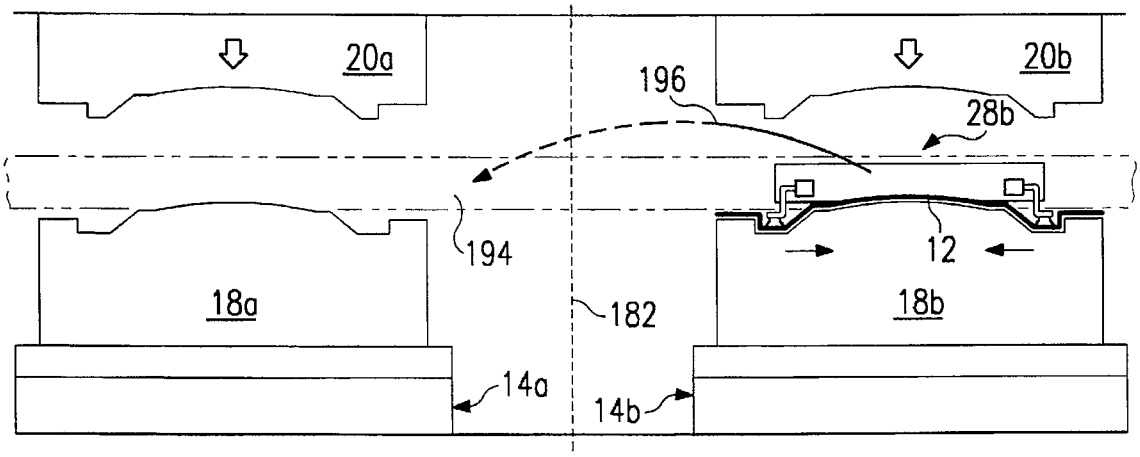
Figure 6E:
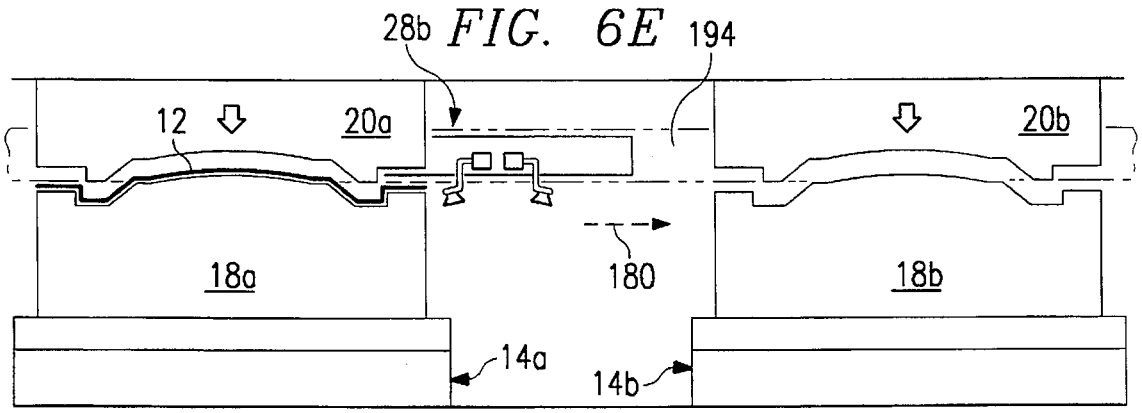
Figure 6F:
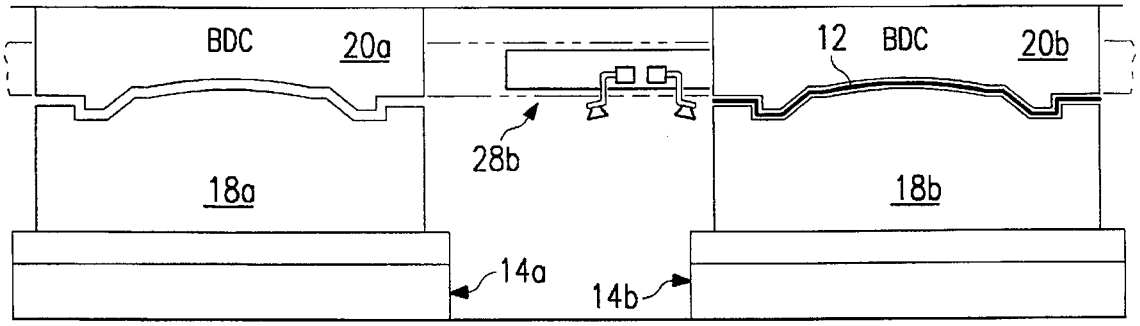
Figure 6G:
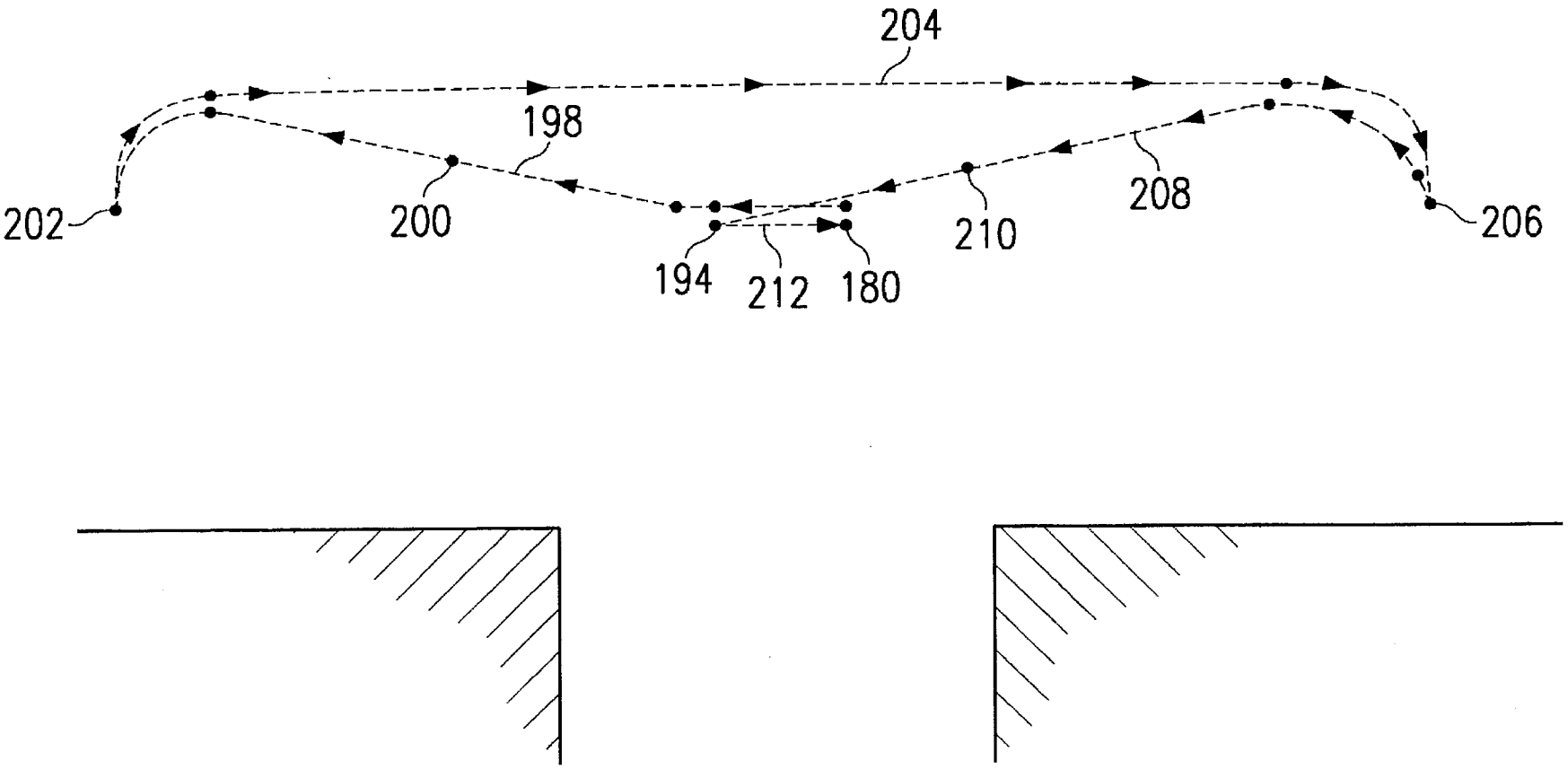

As shown in FIG. 6d, cross bar assembly 28b deposits work piece 12 on upper die 18b. Once released, cross bar assembly 28b moves to a second rest position 194 along a path indicated by arrow 196. The portion of arrow 196 represented by a solid line indicates motion of cross bar assembly 28b and transfer rails 22 and 24 while upper die 20a and 20b are moving over top dead center. Once cross bar assembly 28b exits press station 14b, upper die 20b continues to descend down to perform an operation on work piece 12. During the operation of upper die 20b, cross bar assembly 28b continues to move along the path represented by the dashed portion of arrow 196 to second rest position 194. It is noted that second rest position 194 is located adjacent to first press station 14a. This means that second rest position 194 is located on a side of midpoint 182 between press stations 14*a* and 14*b* that is closer to press station 14*a*. As shown in FIG. 6*e*, cross bar assembly 28*b* returns to first rest position 180 as upper dies 20*a* and 20*b* descend toward lower dies 18*a* and 18*b*. As shown in FIG. 6*g*, cross bar assembly 28*b* is located adjacent to press station 14*b* in first rest position 180 when upper dies 20*a* and 20*b* are located in the bottom dead center position. The method then repeats the steps shown in FIGS. 6*a* through 6*f* to move additional work pieces 12 through transfer press 10.

FIG. 6*g* summarizes the path of cross bar assembly 28*b* as described with respect to FIGS. 6*a* through 6*f*. Cross bar assembly 28*b* begins in first rest position 180. Cross bar assembly moves along path 198 and cross bars 130*b* and 132*b* begin to separate at point 200. Cross bar assembly 28*b* continues along path 198 and engages a work piece 12 at press station 14*a* at point 202. Cross bar assembly 28*b* transfers work piece 12 to press station 14*b* along path 204 and releases work piece 12 at a point 206. Cross bar assembly 286 then returns to second rest position 194 along path 208. At point 210, cross bars 130*b* and 132*b* are back to the initial separation. Cross bar assembly 28*b* then returns to the first rest position 180 along a path 212.

A portion of the movement of cross bar assemblies 28*a* through 28*f* is accomplished while upper dies 20*a* through 20*f* are in motion. This decreases the time required to move a work piece 12 between adjacent press stations 14 and thus increases the production rate of transfer press 10. Additionally, the method according to the teachings of the present invention uses two rest positions 180 and 194 for each of the cross bar assemblies 28*a* through 28*f* to allow cross bar assemblies 28*a* through 28*f* to enter and exit press stations 14*a* through 14*f* at an increased speed.

Figure 7:
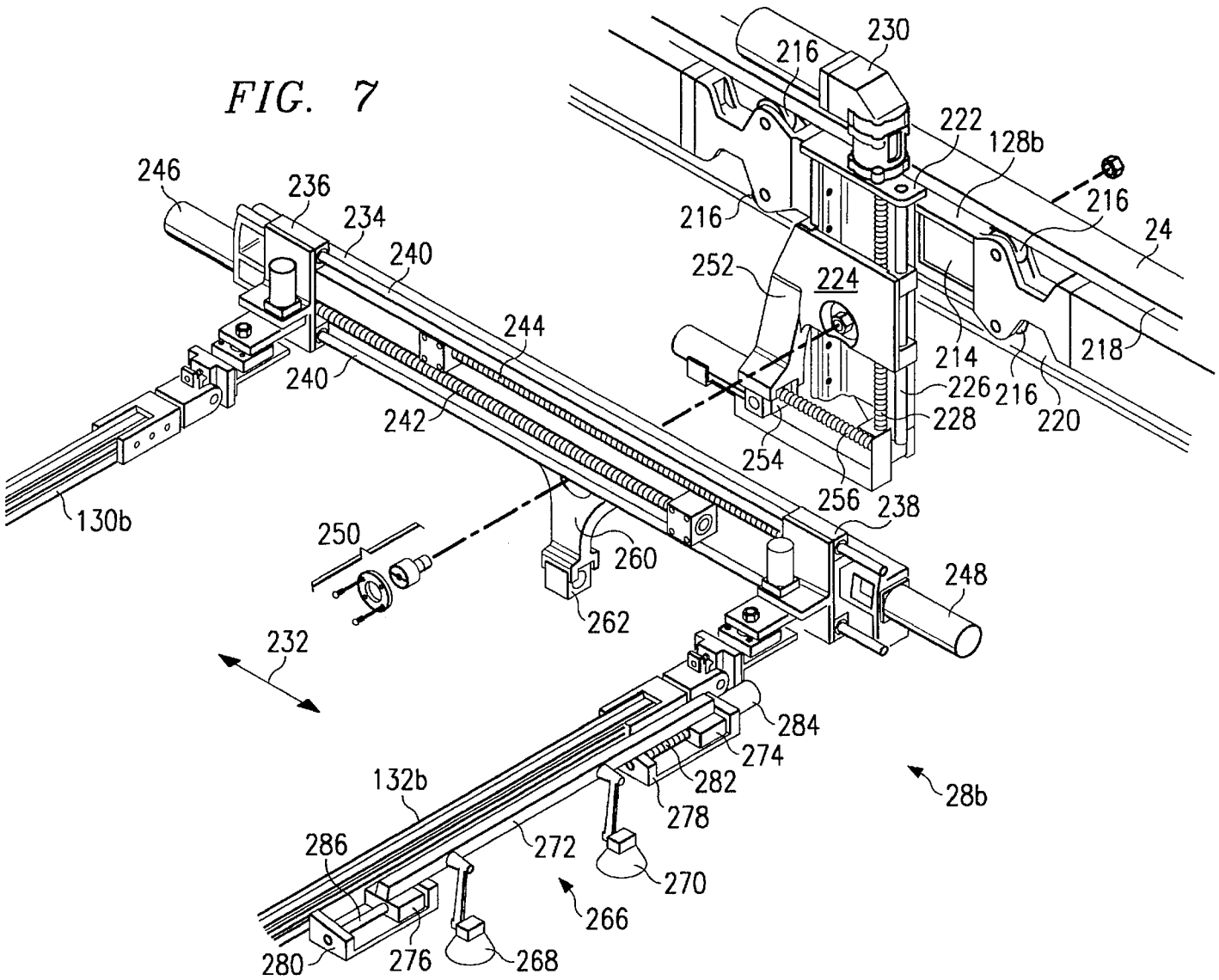
FIG. 7 is an exploded, perspective view of a cross bar assembly constructed according to the teachings of the present invention for use in the multi-station press of FIG. 1.

FIG. 7 is an exploded, perspective view of a cross bar assembly indicated generally at 28*b* and constructed according to the teachings of the present invention. It is noted that FIG. 7 only shows one end of cross bar assembly 28*b*. The opposite end of cross bar assembly 28*b* is similarly constructed. Additionally, the aspects of cross bar assembly 28*b* shown in FIG. 7 are equally applicable to cross bar assemblies 28*a*, and 28*c* through 28*f*. As described above with respect to FIGS. 6*a* through 6*g*, cross bar assembly 28*b* reciprocates on transfer rails 22 and 24 between adjacent press stations 14*a* and 14*b* to move work pieces 12 through transfer press 10 to create a completed output. Cross bar assembly 28*b* is operable to dynamically orient a work piece 12 during transfer between adjacent press stations so as to properly position the work piece 12 for the receiving press station 14.

Linear movement of cross bar assembly 28*b* is provided by carriage 128*b* as described above. Carriage 128*b* comprises a main body 214. A plurality of rollers 216 are rotatably disposed in top and bottom pairs on opposite ends of main body 214. Rollers 216 slidably engage tracks 218 and 220 on rail 24. Tracks 218 and 220 maintain carriage 128*b* on rail 24 and allow only motion in the transfer direction as indicated by arrow 26.

Carriage 128*b* allows for vertical, horizontal and rotational orientation of cross bars 130*b* and 132*b*. Cross bar assembly 28*b* comprises a vertical member 222 coupled to carriage 126*b*. A vertical slide 224 is coupled to vertical member 222 and is operable to translate from top to bottom of vertical member 222. Slide 224 translates on rods 226. Additionally, a lead screw 228 extends from top to bottom in vertical member 222. Lead screw 228 is rotated by motor 230 extending from the top of vertical member 222.

In operation, cross bar assembly 28*b* adjusts the height of cross bars 130*b* and 132*b* at carriage 128*b*. Motor 230 rotates lead screw 228 by a predetermined amount to establish a desired height. Vertical slide 224 moves up or down on rods 226 of vertical member 222.

Cross bars 130*b* and 132*b* may each independently move in the direction of arrow 232. Cross bar assembly 28*b* comprises a horizontal member 234 that is pivotally coupled to slide 224 of vertical member 222. Cross bar 130*b* is pivotally couple to horizontal slide 236 and cross bar 132*b* is pivotally coupled to a horizontal slide 238. Horizontal slides 236 and 238 are slidably coupled to horizontal member 234 on horizontal rods 240. Horizontal member 234 further includes first and second lead screws 242 and 244. Lead screws 242 and 244 are disposed along a length of horizontal member 234 such that lead screws 242 and 244 overlap over a portion of the length of horizontal member 234. Lead screws 242 and 244 are controlled by servo motors 246 and 248, respectively.

In operation, cross bars 130*b* and 132*b* move together and apart on horizontal member 234. For example, lead screw 242 moves cross bar 130*b* toward or away from cross bar 132*b*. Motor 246 rotates lead screw 242. Horizontal slide 236 thus moves along lead screw 242 toward or away from cross bar 132*b*. Similarly, cross bar 132*b* moves toward or away from cross bar 130*b*. Motor 248 rotates lead screw 244. Based on the rotation of lead screw 244, horizontal slide 238 either moves toward or away from cross bar 130*b*.

Horizontal member 234 is pivotally coupled to vertical slide 224 by a pivot screw assembly 250. Horizontal member 234 rotates on vertical slide 224. A rotation lever 252 extends from vertical slide 224. A pivot block 254 is pivotally coupled to an end of rotation lever 252. A lead screw 256 extends from a motor 258 through pivot block 254 to provide rotational movement of horizontal member 234 on vertical slide 224. Additionally, a lead screw support member 260 extends from horizontal member 234. A bearing block 262 is pivotally coupled to an end of lead screw support 260 and has an opening 264 for receiving lead screw 256.

In operation, horizontal member 234 is rotated on vertical side 224. Servo motor 258 rotates lead screw 256 in bearing block 262 and pivot block 254. The distance between pivot block 254 and bearing block 262 changes thus causing horizontal member 234 to pivot on vertical side 224.

As shown in FIG. 3, each cross bar 130*b* and 132*b* includes two vacuum cup assemblies 266. The number of vacuum cup assemblies on each cross bar 130*b* and 132*b* may be varied depending on the width of transfer press 10 or the size of work pieces 12 used with transfer press 10. One vacuum cup assembly 266 is shown for purposes of illustration in FIG. 7.

Vacuum cup assembly 266 comprises first and second vacuum cups 268 and 270 coupled to a vacuum cup support 272. Transverse slides 274 and 276 are coupled at opposite ends of vacuum cup support 272. Additionally, transverse slides 274 and 276 rest within transverse slide supports 278 and 280, respectively. A lead screw 282 extends through transverse slide 274 from end to end of transverse slide support 278. A motor 284 is coupled to lead screw 282. Additionally, a slide rod 286 extends between the ends of transverse slide support 280 and passes through transverse slide 276.

In operation, vacuum cups 268 and 270 may be positioned along cross bar 132*b* by vacuum cup assembly 220. Motor 284 rotates lead screw 282. Thus, transverse slide block 274 causes vacuum cup support 272 to translate along the length of cross bar 132*b*. Transverse slide 276 similarly slides along rod 286. The length of transverse slide supports 278 and 280 limit the range of motion of vacuum cup assembly 266.

Figure 8:
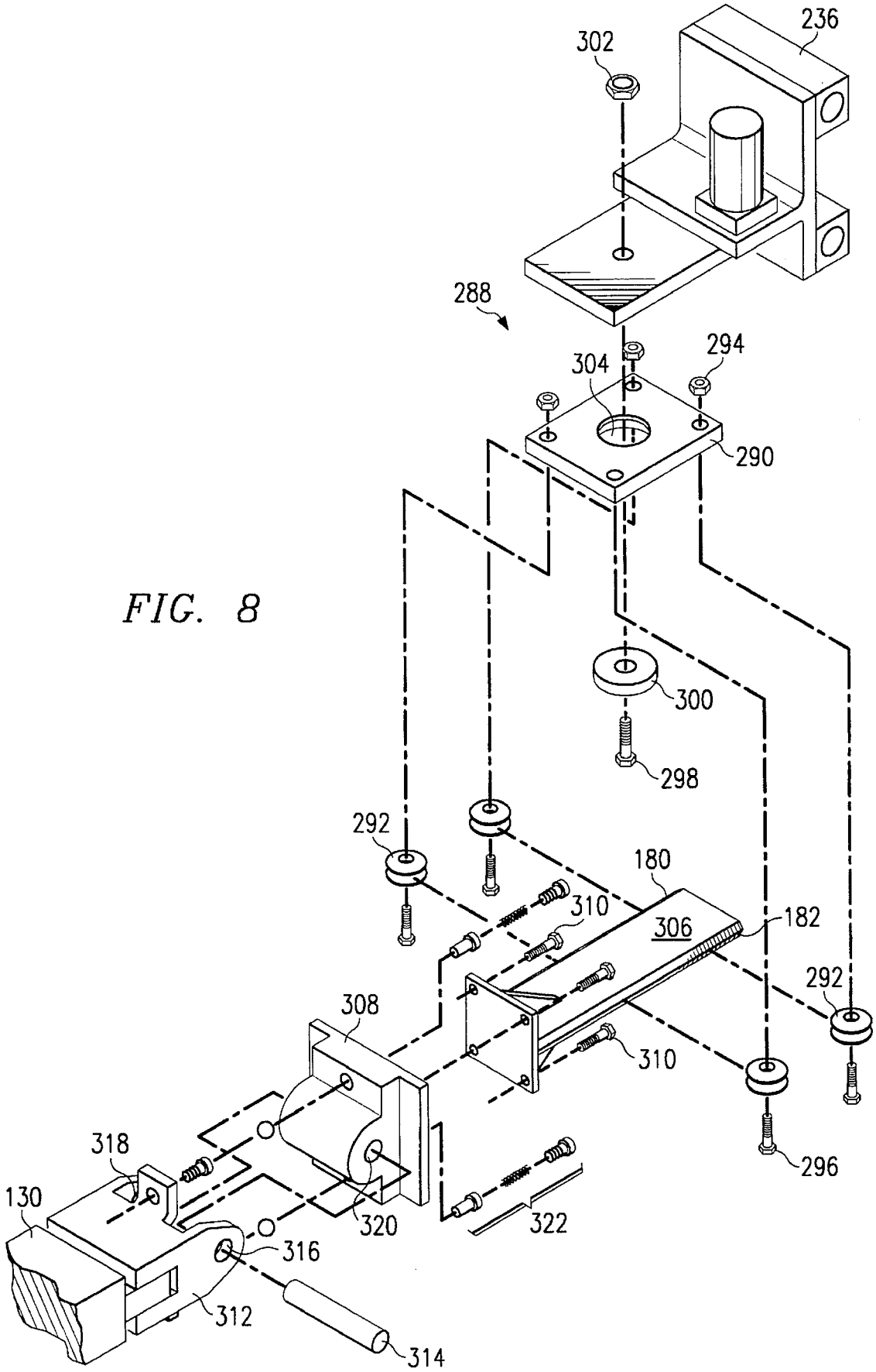
FIG. 8 is an exploded, perspective view of a joint constructed according to the teachings of the present invention for coupling a cross bar to a horizontal member in the cross bar assembly of FIGS. 3 and 7.

FIG. 8 illustrates an embodiment of a Joint indicated generally at 288 for use in coupling a cross bar 130 or 132 to a horizontal member 234 of a cross bar assembly 28. Joint 288 is described in conjunction with cross bar 130 for convenience only. Joint 288 is similarly applied to cross bar 132. Joint 288 comprises a pivot bracket 290 having four rollers 292 coupled thereto by a nut 294 and a bolt 296. Pivot bracket 290 is coupled to slide 236 by a bolt 298 passing through a washer 300 and a nut 302. Washer 300 is pivotally disposed in an opening 304 of pivot bracket 290. Rollers 292 engage a sliding bracket 306 along first and second bevelled sides 180 and 182 of sliding bracket 306. Sliding bracket 306 is coupled to a hinge body 308 by a plurality of bolts 310. Additionally, a pivot bracket 312 is coupled to hinge body 308 by a pin 314 that passes through first and second openings 316 and 318 of pivot bracket 312 and opening 320 of hinge body 308. Thus, pivot bracket 312 may rotate on hinge body 308 around pin 314. Pivot bracket 312 is coupled to a cross bar 130. First and second spring loaded screw assemblies 322 are provided to limit the motion of pivot bracket 312 on hinge body 308.

In operation, joint 288 allows the length of cross bar 130 to be increased when the height of cross bar 130 is not the same at both ends of cross bar 130. Extension of cross bar 130 is accomplished by pivoting pivot bracket 290 on pin 314 at hinge body 308. Additionally, sliding bracket 306 slides on rollers 292 to extend the length of cross bar 130 from slide 238. Additionally, joint 288 allows cross bar 130 to cross transfer press 10 at an angle to the transfer direction indicated by arrow 26. In this manner, slide 236 pivots on pivot bracket 290. Washer 300 remains stationary as pivot bracket 290 rotates around washer 300.

FIGS. 9*a* through 9*f* illustrate various orientations that a cross bar assembly 28 may achieve according to the teachings of the present invention. Each of the possible motions of cross bar assembly 28 described above with respect to FIGS. 7 and 8 are independently programmable to achieve a desired orientation. Thus, it is a technical advantage of the present invention that cross bar assemblies 28*a* through 28*f* may be programmed independently to provide a desired orientation of a work piece 12 for each press station 14*a* through 14*f*.

FIGS. 9*a* through 9*f* illustrate various fundamental orientations of a cross bar assembly 28. In any particular application of cross bar assembly 28, the orientation shown in FIGS. 9*a* through 9*f* may be combined or modified to achieve the desired orientation. It is thus understood that the orientations in FIGS. 9*a* through 9*f* are shown by way of example and not by way of limitations and do not illustrate all possible orientations of cross bar assembly 28.

Figure 9A:
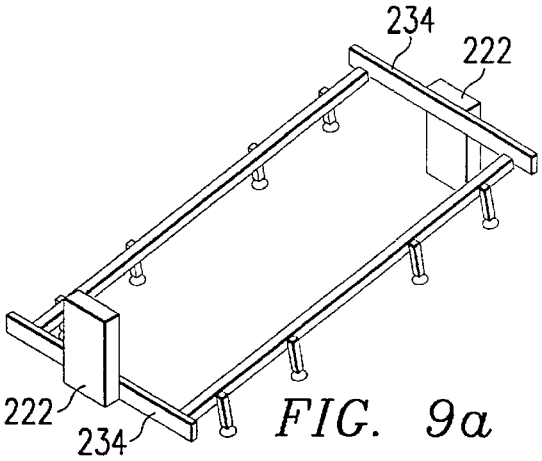
FIGS. 9*a* through 9*f* illustrate various cross bar orientations that may be achieved with the cross bar assembly of FIGS. 3 and 7 for dynamically orienting a work piece for adjacent press stations in the multistation press of FIG. 1 according to the teachings of the present invention.
Figure 9B:
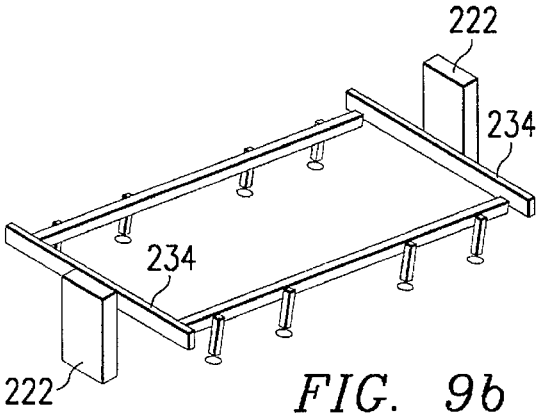

A technical advantage of the present invention is that cross bar assembly 28 can be programmed to tilt a work piece 12 in a direction that is perpendicular to the direction of flow. FIGS. 9*a* and 9*b* illustrate this orientation wherein horizontal members 234 translate up and down on vertical members 222. Another technical advantage of the present invention is that cross bars 130 and 132 may be programmed to be raised and lowered together by movement of horizontal members 234. Thus, cross bar assemblies 28*a* through 28*f* may raise or lower a part irrespective of the movement of transfer rails 22 and 24.

Figure 9C:
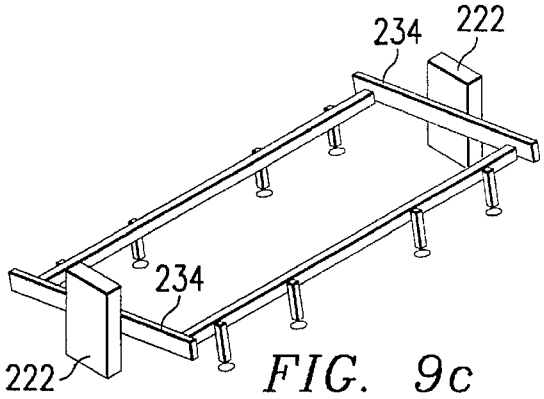
Figure 9D:
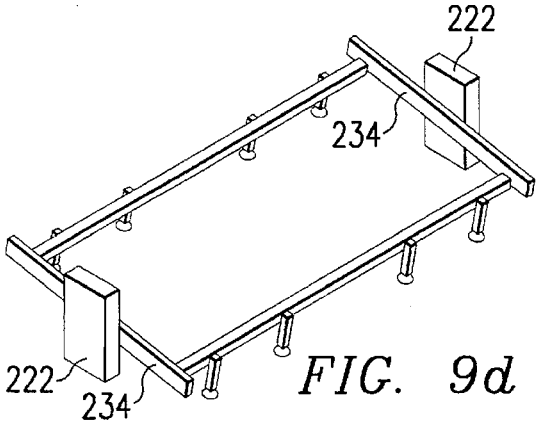

Another technical advantage of the present invention is that cross bar assembly 28 can be programmed to tilt in the direction of flow of transfer press 10. FIGS. 9*c* and 9*d* illustrate this orientation which is achieved by rotating horizontal member 234 on vertical member 222.

Figure 9E:
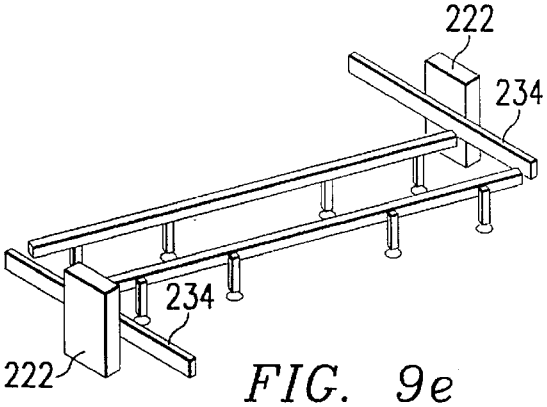
Figure 9F:
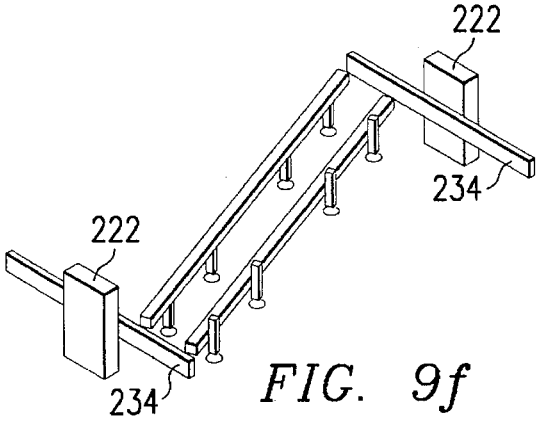

FIGS. 9*e* and 9*f* illustrate independent programmable movement of cross bars 130 and 132 on horizontal members 234. FIGS. 9*e* and 9*f* show that a work piece 12 can also be tilted at an angle to the direction of flow. Similarly, movement of cross bars 130 and 132 on horizontal members 234 provide another technical advantage. Horizontal movement of cross bars 130 and 132 allows press station 14*a* through 14*b* to be spaced apart by non-uniform distances. The horizontal movement of cross bars 130 and 132 allow a portion of the transfer distance between press stations to be traversed by motion of cross bars 130 and 132 on cross bar assembly 28.

Figure 10:
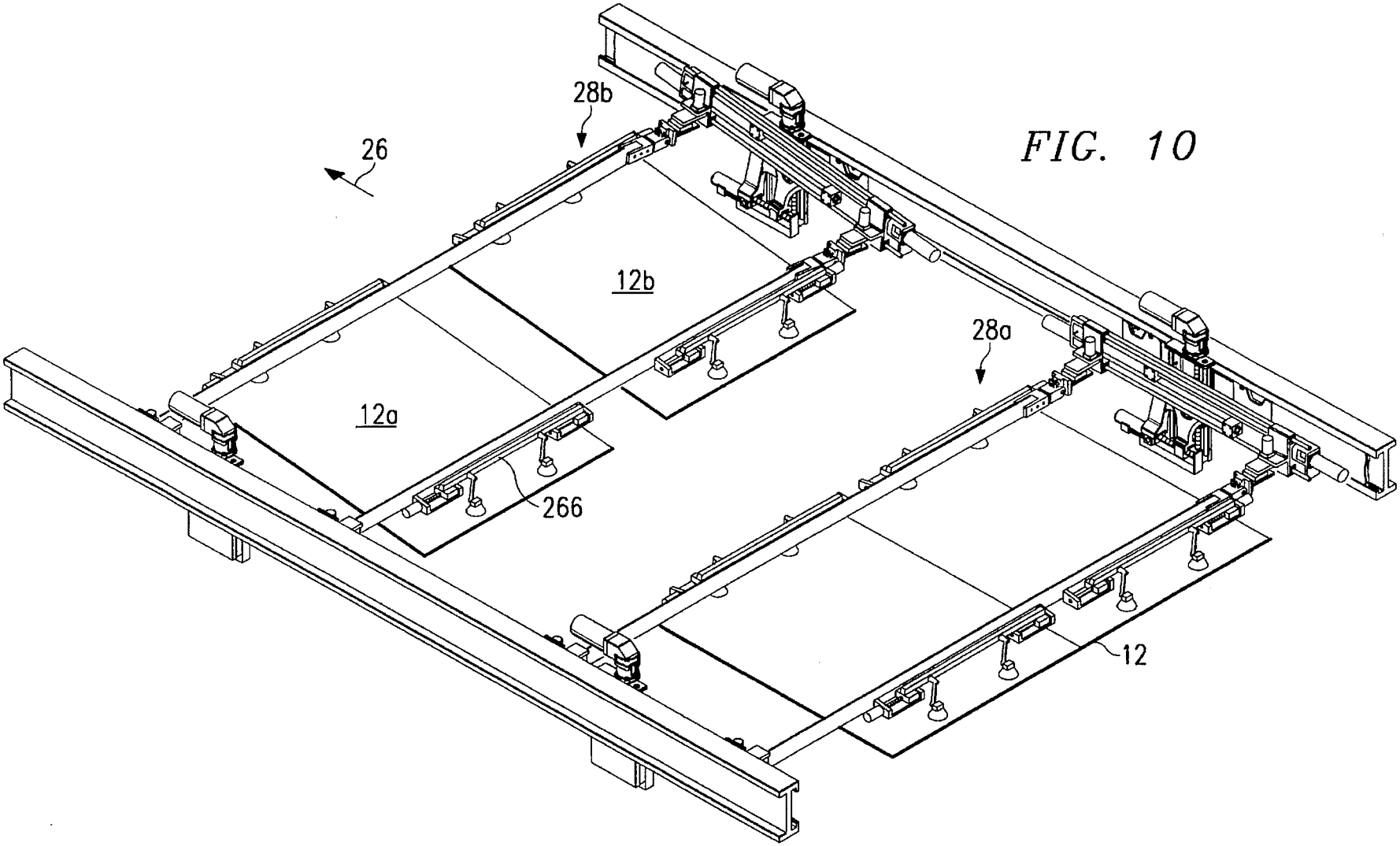
FIG. 10 is a perspective view showing independent movement of vacuum cup sets of the cross bar assembly of FIGS. 3 and 7 according to the teachings of the present invention for use in the multi-station press of FIG. 1.

A technical advantage of the present invention is that multiple work pieces 12 may be moved by a single cross bar assembly 28. Vacuum cup assemblies 266 are programmable to operate independently. As shown in FIG. 10, two work pieces 12*a* and 12*b* are moved by a single cross bar assembly 28*b*. A work piece 12 is engaged by cross bar assembly 28*a* for transport to press station 14*a*. At press station 14*a*, work piece 12 is cut into two pieces 12*a* and 12*b*. Cross bar assembly 28*b* engages two work pieces 12*a* and 12*b* at press station 14*a* and transfers the two pieces to press station 14*b*. Vacuum cup assemblies 266 separate work pieces 12*a* and 12*b* along the width of transfer press 10. Similarly, each cross bar 130 and 132 may be programmed to transfer a separate work piece 12 by proper positioning of cross bars 130 and 132 on horizontal members 234.

It is noted that cross bar assembly 28 provides several other technical advantages for the present invention. For example, cross bar assembly 28 is not designed for a specific work piece 12. Rather, cross bar assembly 28 is generally applicable to a wide range of work pieces 12 having varying shapes and sizes. Furthermore, cross bar assembly 28 may include an overload sensor which releases cross bar 130 or 132 when it hits an interference thus reducing damage to transfer press 10.

Although the present invention has been described in detail, it should be understood that various changes, substitutions and alternations can be made hereto without departing from the spirit and scope of the invention as defined by the appended claims.

What is claimed is:

1. A system for transferring a work piece between first and second press stations in a multi-station press having a plurality of associated upper and lower dies, said system comprising:

at least one cross bar assembly extending above the press stations perpendicular to the transfer direction of the press;

a plurality of holding devices coupled to said cross bar assembly for removably engaging a work piece;

said cross bar assembly having a first rest position adjacent to the second press station and a second rest position adjacent to the first press station;

a transfer mechanism for moving said cross bar assembly from said first rest position to the first press station;

said cross bar assembly and holding devices operable to engage a work piece at the first press station and to move and deposit the work piece at the second press station;

said transfer mechanism then operable to move said cross bar assembly to said second rest position; and said transfer mechanism then retuning said cross bar assembly to said first rest position to prepare for a subsequent work piece transfer.

2. The system of claim 1, further comprising:

each of said upper dies having a top dead center position corresponding to a maximum separation from said associated lower die; and a predetermined portion of the movement from and to said rest positions of said cross bar assembly occurs while said upper die is separated from said lower die by less than said maximum separation.

3. The system of claim 1, wherein each of said cross bar assemblies comprise two cross bars movable together and independently of one another.

4. The system of claim 1, wherein said each said cross bar assembly comprises a pair of opposite carriages with a cross bar extending therebetween.

5. The system of claim 4, wherein said cross bars are independently operable to rotate, to be raised and lowered and to move back and forth with respect to said carriages so as to dynamically orient the work piece for each press station.

6. The system of claim 4, wherein said cross bar assembly further comprises:

a vertical member coupled to said carriage for translating said cross bars in a direction normal to the transfer direction;

a horizontal member coupled to said vertical member for translating said cross bars in the transfer direction;

said cross bars pivotally coupled to said horizontal member; and said cross bar independently programmable to translate on said vertical and horizontal members.

7. The system of claim 6, wherein said vertical member and said horizontal member each include a lead screw and an independently controllable servo motor.

8. The system of claim 6, and further comprising a rotational member coupled to said vertical and horizontal members for rotating said horizontal member with respect to said vertical member.

9. The system of claim 8, wherein said rotational member comprises:

a rotational lever extending from said vertical translation member;

a rotational lead screw support member extending from said horizontal translation member; and a rotational lead screw extending between said rotational lever and said rotational lead screw support member, said lead screw operable to rotate said horizontal member with respect to said vertical member.

10. The system of claim 1, wherein said holding devices comprise vacuum cups.

11. The system of claim 1, wherein said holding devices comprise a plurality of sets of vacuum cups on each cross bar, said vacuum cup sets operable to independently translate on the cross bar.

12. The system of claim 1, wherein said transfer mechanism comprises:

first and second opposite transfer rails disposed parallel to the press stations and extending in the transfer direction;

a plurality of vertical lift assemblies coupled to the transfer rails for raising and lowering the transfer rails; and a transfer drive mechanism for reciprocating said cross bar assemblies on said transfer rails.

13. A system for transferring a work piece in a multi-station press having a plurality of associated upper and lower dies, said system comprising:

first and second opposite transfer rails disposed parallel to said press stations and extending in the transfer direction;

a plurality of carriages having first and second ends and a top and a bottom, said carriages coupled in associated pairs for reciprocating movement on said opposite transfer rails;

a cross bar associated with each pair of carriages and extending above the press stations perpendicular to the transfer direction of the press and coupled between an associated pair of carriages;

a plurality of holding devices coupled to each of said cross bars for removably engaging a work piece to be moved between the press stations; and said cross bars being operable to rotate on said carriages and move from said first end to said second end and from top to bottom on said carriages for dynamically orienting the work piece for each press station.

14. The system of claim 13, and further comprising a plurality of spacing members coupled between adjacent carriages on each transfer rail to coordinate reciprocating movement of said carriages on said transfer rails.

15. The system of claim 13, and further comprising:

a vertical member coupled to each carriage for translating an associated cross bar in a direction normal to the transfer direction;

a horizontal member coupled to each vertical member for translating the associated cross bar in the transfer direction; and each said cross bar pivotally coupled to said horizontal member.

16. The system of claim 15, wherein said vertical member and horizontal member each include a lead screw and a servo motor.

17. The system of claim 15, and further comprising a rotational member coupled to said vertical and horizontal members for rotating said horizontal member with respect to said vertical member.

18. The system of claim 17, wherein said rotational member comprises:

a rotational lever extending from said vertical member;

a rotational lead screw support member extending from said horizontal member; and a rotational lead screw extending between said rotational lever and said rotational lead screw support member, said lead screw operable to rotate said horizontal member with respect to said vertical member.

19. The system of claim 13, wherein said holding devices comprise vacuum cups.

20. The system of claim 13, wherein said holding devices comprise two sets of vacuum cups coupled to said cross bar, said vacuum cups sets operable to independently translate on said cross bar.

21. The system of claim 13, and further comprising a pair of cross bars coupled between each pair of carriages.

22. A system for transferring a work piece between first and second press stations in a multi-station press having a plurality of associated upper and lower dies, said system comprising:

at least one cross bar assembly extending above the press stations perpendicular to the transfer direction of the press for removably engaging a work piece;

each of said upper dies having a top dead center position corresponding to a maximum separation from said associated lower die;

a transfer mechanism for moving said cross bar assembly to transfer a work piece between adjacent press stations;

said cross bar assembly having a rest position located on a side of a midpoint between said press stations closer to said second press station;

said transfer mechanism beginning to move said cross bar assembly from said rest position when said upper and lower dies are separated by less than said maximum separation.

23. A system for transferring a work piece between first and second press stations in a multi-station press having a plurality of associated upper and lower dies, said system comprising:

at least one cross bar assembly extending above said first and second press stations perpendicular to the transfer direction of the press for removably engaging a work piece;

each of said upper dies having a top dead center position corresponding to a maximum separation from said associated lower die;

a transfer mechanism for moving said cross bar assembly between said first and second press stations;

said transfer mechanism operable to move said cross bar assembly away from the second press station to a position on a side of a midpoint between the first and second press stations that is closer to the first press station; and a predetermined portion of said movement from said second press station occurring while said upper die is separated from the lower die by less than a maximum separation.

24. The system of claim 23, wherein each of said cross bar assemblies comprise two cross bars moveable together and independently of one another.

25. The system of claim 24, wherein each cross bar assembly comprises a pair of opposite carriages with said cross bars extending therebetween.

26. The system of claim 25, wherein said cross bars are operable to rotate, to be raised and lowered and to move back and forth with respect to said carriages so as to dynamically orient the work piece for each press station.

* * * * *